US005180269A

United States Patent [19]

Nishioka

[11] Patent Number: 5,180,269

[45] Date of Patent: Jan. 19, 1993

[54] YARN PACKAGE SUPPLY AND EMPTY BOBBIN REMOVING APPARATUS FOR WARPER CREEL

[75] Inventor: Yoshiyuki Nishioka, Kusatsu, Japan

[73] Assignee: Murata Kikai Kabushiki Kaisha, Kyoto, Japan

[21] Appl. No.: 708,878

[22] Filed: May 31, 1991

[30] Foreign Application Priority Data

Jun. 1, 1990 [JP] Japan ..... 2-57212[U]

[51] Int. Cl.[5] ..... B65H 67/00

[52] U.S. Cl. ..... 414/331; 414/282; 414/910; 414/911

[58] Field of Search ..... 414/277, 280, 281, 282, 414/286, 331, 608, 910, 911

[56] References Cited

U.S. PATENT DOCUMENTS 4,084,709 4/1978 Bührer ..... 414/619
4,629,143 12/1986 Griffin ..... 414/911 X
4,685,852 8/1987 Rubin et al. ..... 414/280 X
4,723,885 2/1988 Grube et al. ..... 414/331
4,783,021 11/1988 Nagasawa ..... 414/331 X
4,830,561 5/1989 Kraske ..... 414/618 X
4,988,252 1/1991 Yamamoto et al. ..... 414/331

*Primary Examiner*—David A. Bucci
*Assistant Examiner*—James Keenan
*Attorney, Agent, or Firm*—Spensley Horn Jubas & Lubitz

[57] ABSTRACT

A yarn package supply and empty bobbin removing apparatus for a warper creel, for removing empty bobbins from a plurality of pegs of a creel and putting yarn packages on the pegs, which includes a yarn package transfer frame having a shape resembling the letter H and supported so as to be located opposite to the pegs. The yarn package transfer frame is provided with holding devices arranged in two rows separated from each other by a distance corresponding to the distance between the adjacent rows of pegs.

5 Claims, 4 Drawing Sheets

YARN PACKAGE SUPPLY AND EMPTY BOBBIN REMOVING APPARATUS FOR WARPER CREEL

FIELD OF THE INVENTION

The present invention relates to a yarn package supply and empty bobbin removing apparatus for removing empty bobbins from a plurality of pegs held on a warper creel and supplying yarn packages onto the pegs.

RELATED ART STATEMENT

A conventional warper for a warp preparing process draws out yarns from a plurality of yarn packages supported on a warper creel and winds the yarns in a warp beam. Therefore, a large number of yarn packages corresponding to the number of warp yarns of a fabric to be woven are supported on the pegs arranged in a vertical plane in lines and columns at regular intervals large enough to obviate interference between the yarns unwound from the adjacent yarn packages. It has been a usual practice to remove empty bobbins from the pegs and to put yarn packages on the pegs by the manual work of operators.

The applicant of the present application proposed mechanical means intended to save labor needed for such in Japanese Patent Laid-open (Kokai) No. 64-81771. As shown in FIGS. 5 and 6, this mechanical means comprises a yarn package supply apparatus having a carriage 56 provided with wheels 53 and 54 that roll along rails 51. The wheel 53 is driven by a motor 52 to move the carriage 56. The carriage can be stopped at a predetermined position. A frame 57 is set upright on the carriage 56, and a lifter 59 mounted on the frame is moved vertically by a cylinder actuator 58. A motor 65 held on the lifter 59 turns a first shaft 60 through a lever 64 provided with a pin 63, and a lever 62 provided with a slot 61 receiving the pin 63 of the lever 64 to turn a yarn package transfer arm 69 clockwise or counterclockwise, as viewed in FIG. 5, through an angle of 90°. A motor 66 held on the lifter 59 turns a second shaft 70 through a lever 68 and a lever 67 provided with a slot to turn the yarn package transfer arm 69 in directions perpendicular to the paper as viewed in FIG. 5. A motor 71 turns the yarn package transfer arm 69 about an axis perpendicular to the longitudinal axis of the yarn package transfer arm 69 and intersecting the yarn package transfer arm 69 at the middle point of the same. Six support arms 74 are fixed to the yarn package transfer arm 69 to support yarn packages 75 thereon. The yarn packages are held on the support arms 74 by yarn package holding devices 79 each having gripping members 78, levers 77 for operating the gripping members 78, and cylinder actuators 76 for operating the levers 77.

Empty bobbin holding devices 80 are provided on the yarn package transfer arm 69. Each empty bobbin holding device 80 is separated from the corresponding yarn package holding device 79 by an angle of 90°. Each empty bobbin holding device 80 comprises a bobbin support member 81 fixed to the yarn package transfer arm 69 so as to receive an empty bobbin thereon, bobbin holding members 82 for holding the bobbin seated on the bobbin support member 81, and a cylinder actuator for operating the bobbin holding members 82. A creel carriage 85 is disposed in front of the yarn package transfer arm 69, and six pegs are fixed to the creel carriage 85 so as to project toward the yarn package transfer arm 69. A yarn package supply belt 87 is extended through a space between the frame 57 and the creel carriage 85 to convey yarn packages 88. A bobbin conveyor 90 is disposed adjacent to the yarn package supply belt 87 to convey empty bobbins dropped thereon.

In removing empty bobbins supported on the pegs 86, the package transfer arm 69 is turned in the direction of an arrow A (FIG. 6). To hold the empty bobbins by the empty bobbin holding devices 80, the carriage 56 is moved backward, i.e., in a direction of an arrow G after holding the empty bobbins by the empty bobbin holding devices 80 to remove the empty bobbins from the pegs 86. Then, the yarn package transfer arm 69 is turned on the second shaft 70 through an angle of 90° in the direction of an arrow C and on the first shaft 60 through an angle of 90° in the direction of an arrow E, the carriage 56 is moved further backward in the direction of the arrow G to locate the empty bobbins 91 above the empty bobbin conveyor 90, and then the bobbin holding members 82 of the empty bobbin holding devices 80 are opened to drop the empty bobbins 91 onto the empty bobbin conveyor 90 for transportation. Subsequently, the yarn package transfer arm 69 is turned in the direction of an arrow B to direct the yarn package holding devices 79 downward, the carriage 56 is advanced in the direction of an arrow H to a position where the yarn package holding devices 79 are located above the yarn package supply belt 87, the lifter 59 is lowered, and then the yarn package holding devices 79 are operated to hold yarn packages 88 supported on the yarn package supply belt 87. Then, the carriage 56 is advanced in the direction of the arrow H while the lifter 59 is being raised, the yarn package transfer arm 69 is turned on the first shaft 60 in the direction of an arrow F through an angle of 90° and the same is turned on the second shaft 70 in the direction of an arrow D through an angle of 90°, the carriage is advanced further beyond a position indicated by solid lines in FIG. 5 to put the yarn packages 75 on the pegs 86, the gripping members 78 of the yarn package holding devices 79 are opened, and then the carriage is moved backward to complete a series of steps of operation.

The foregoing apparatus proposed by the applicant of the present application is capable of mechanically achieving the operation for removing empty bobbins from the creel and the operation for supplying yarn packages to the creel. However, the mechanical means is not satisfactory in working efficiency and requires much time to perform such operations with a large number of creels, because the operation for removing the empty bobbins from the pegs of the creel and the operation for putting yarn packages on the pegs of the creel are performed separately.

OBJECT AND SUMMARY OF THE INVENTION

To incorporate further improvements in the foregoing mechanical means, it is an object of the present invention to provide a yarn package supply and empty bobbin removing apparatus for a warper creel, for removing empty bobbins from a plurality of pegs of a creel and putting yarn package on the pegs, which includes a yarn package transfer frame having a shape resembling the letter H and supported so as to be located opposite to the pegs. The yarn package transfer frame is provided with holding devices arranged in two rows separated from each other by a distance corresponding to the distance between the adjacent rows of pegs. The yarn package supply apparatus is capable of continuously carrying out an operation for removing empty bobbins from the pegs and an operation for putting yarn packages on the pegs.

Empty bobbins are held by empty bobbin holding devices and removed from the pegs, the yarn package transfer frame is shifted by a distance corresponding to the pitch of the rows of pegs so that the yarn packages held by yarn package holding devices are located opposite to the pegs from which the empty bobbins have been removed, respectively, and then the yarn packages are put on the pegs.

BRIEF DESCRIPTION OF THE DRAWINGS

FIGS. 1 to 4 are views of a yarn package supply apparatus in a preferred embodiment according to the present invention, in which:

FIG. 1 is a side view,

FIG. 2 is a front view of a yarn package transfer frame,

FIG. 3 is a view of assistance in explaining the action of a yarn package transfer frame in connection with a parallel creel, and FIG. 4 is a front view of another yarn package transfer frame in connection with a zigzag creel;

DESCRIPTION OF THE PREFERRED EMBODIMENT

Figure 1:
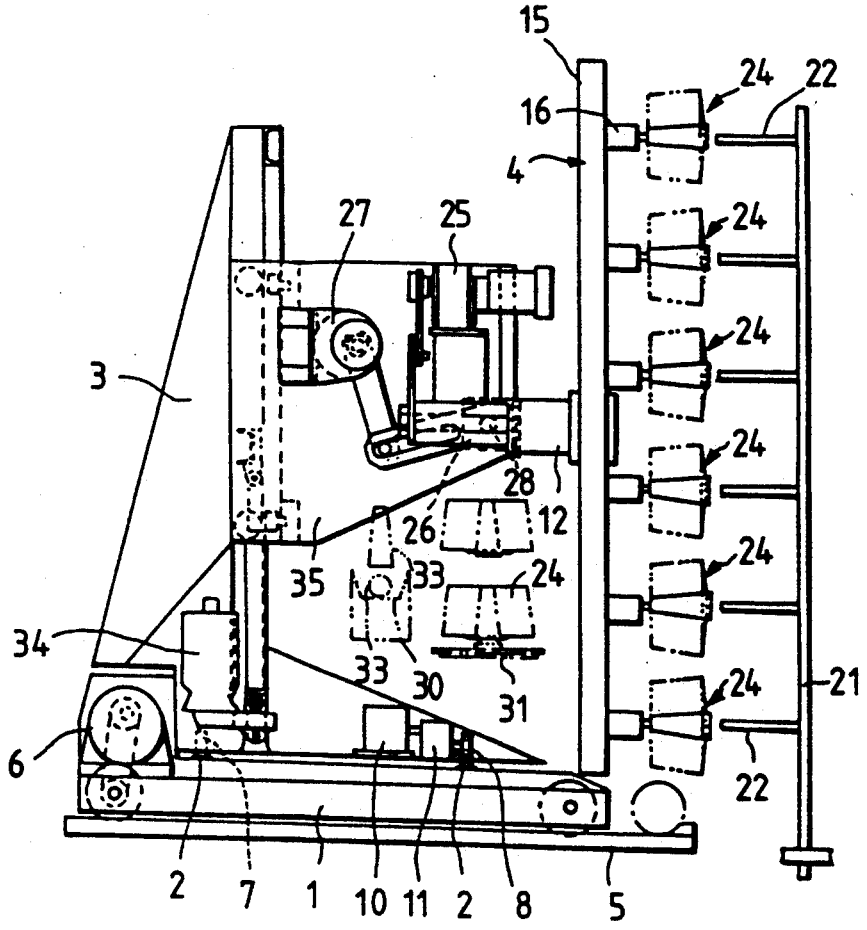

A yarn package supply and empty bobbin removing apparatus in a preferred embodiment according to the present invention will be described with reference to FIGS. 1 to 4. As shown in FIG. 1, the yarn package supply and empty bobbin removing apparatus is the same in its fundamental construction as the foregoing previously proposed apparatus. The apparatus is different from the foregoing apparatus in that rails 2 are arranged on a carriage 1 to move a frame 3 fixedly holding mechanisms along the rails 2 and that yarn package transfer frame 4 and the associated devices are partially different from those of the foregoing apparatus.

The carriage 1 is driven for movement along rails 5 by a motor 6. The rails 2 are extended on the carriage 1 so as to extend in a direction rectangular to the rails 5. Wheels 7 and 8 attached to the frame 3 roll along the rails 2. The wheel 8 is driven through a reduction gear 11 by a motor 10 to move the frame 3 to an optional position.

Figure 2:
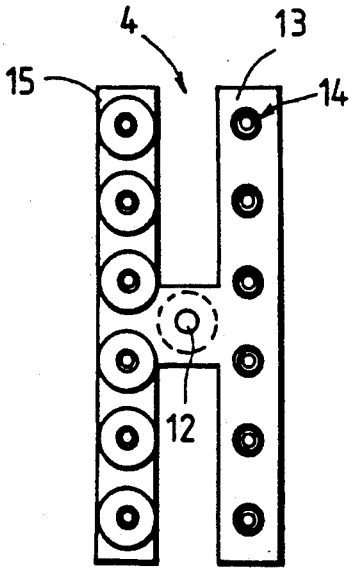
Figure 3:
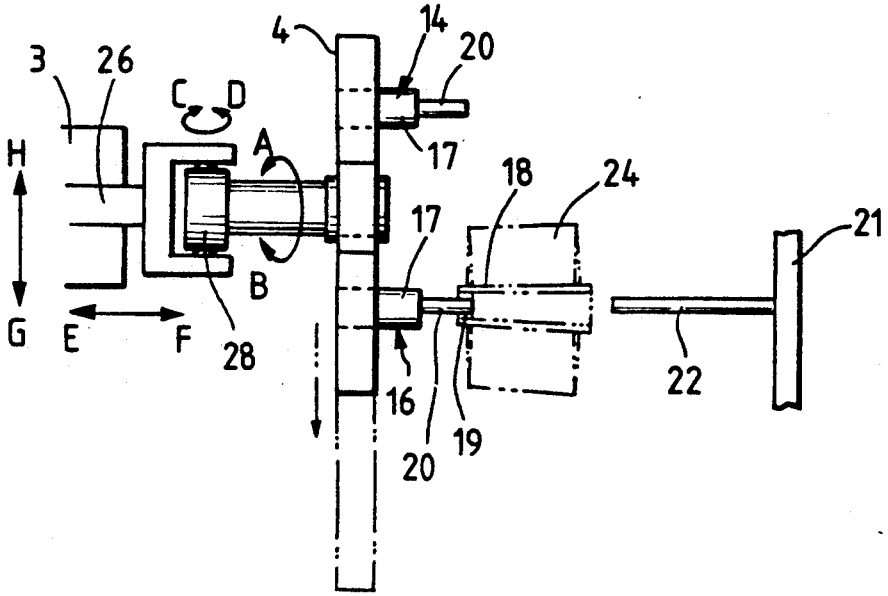
Figure 5:
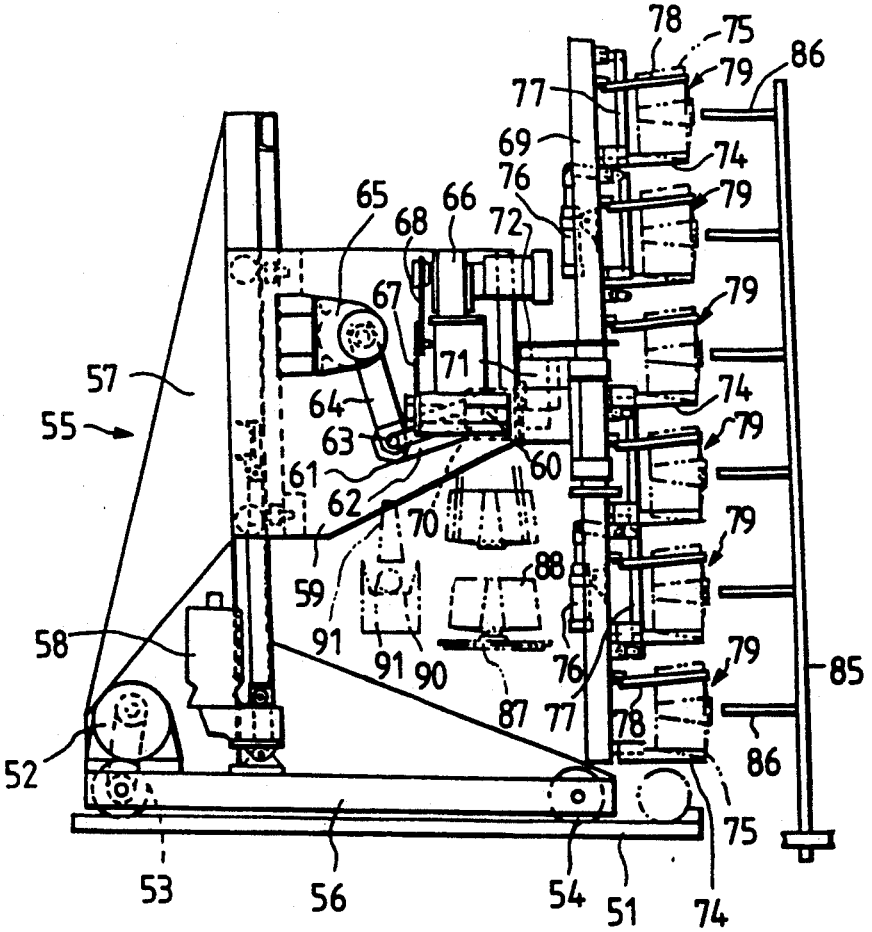
FIG. 5 PRIOR ART
FIG. 5 is a side view of a known yarn package supply apparatus.
Figure 6:
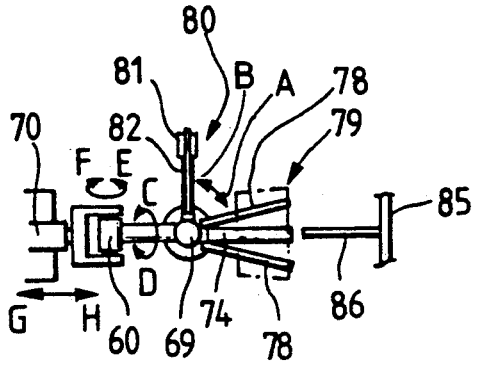
FIG. 6 PRIOR ART
FIG. 6 is a view for explaining the action of a yarn package transfer arm; and FIGS. *7a* to *7d* are schematic plan views showing movement of a creel and yarn package transfer frame.
Figure 7A:
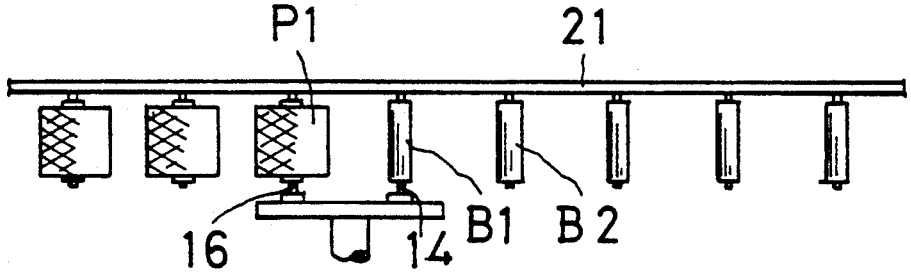
Figure 7B:
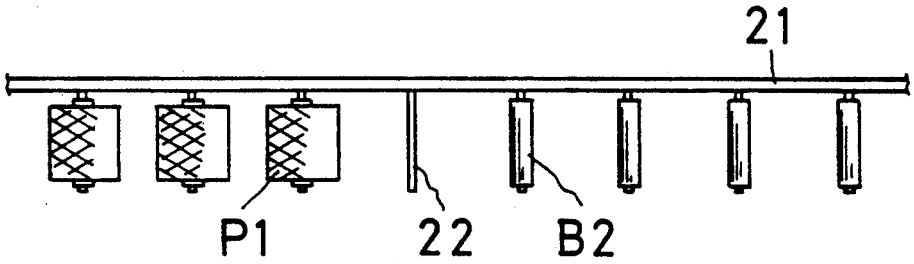
Figure 7C:
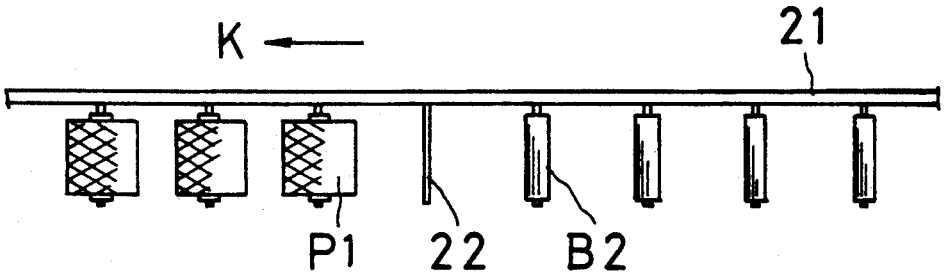
Figure 7D:
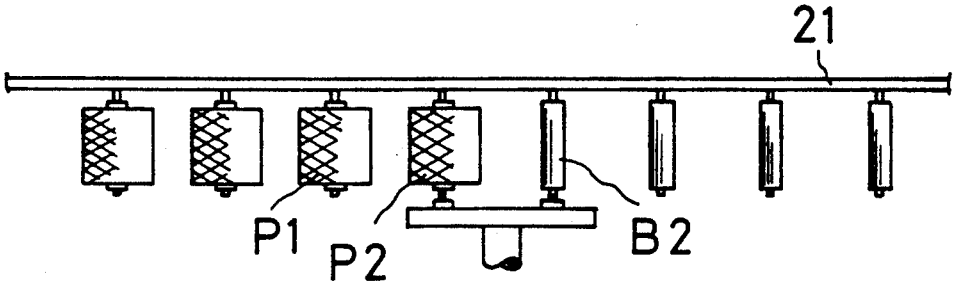

As shown in FIG. 2, the yarn package transfer frame 4 has a shape resembling the letter H in plan view and has a first bar 13 and a second bar 15. The yarn package transfer frame 4 is fixed to a shaft 12. Empty bobbin holding devices 14 are arranged on the first bar 13, and yarn package holding devices 16 are arranged on the second bar 15. As shown in FIG. 3, the empty bobbin holding devices 14 and the yarn package holding devices 16 are the same in construction. Each of the empty bobbin holding devices 14 and the yarn package holding devices 16 has a gripper 19 that is operated by a pneumatic actuator 17 so as to engage the inner surface of a bobbin 18 to hold the bobbin 18. Normally, the gripper 19 is retracted in a hollow shaft 20 and is projected from the hollow shaft 20 by the pneumatic actuator 17 to engage the inner surface of the bobbin 18.

The shaft 12 is fixed to the center of the H-shaped yarn package transfer frame 4. Other components and construction are similar to those of the foregoing apparatus and hence the description thereof will be omitted.

In removing empty bobbins from the pegs 22 of a creel 21, the frame 3 is moved in the direction of an arrow G (FIG. 3) by the motor 10 to a position where the first bar 13 is located opposite to a row of the pegs 22. Then, the carriage 1 is moved together with the frame 3 in the direction of an arrow F by the motor 6 to insert the hollow shaft 20 of the empty bobbin holding devices 14 into the bore of the empty bobbins, and then the pneumatic actuators 17 projects the grippers 19 from the hollow shafts 20 to hold the empty bobbins. Then, the carriage is moved together with the frame 3 by the motor 6 in the direction of an arrow E to remove the empty bobbins from the pegs 22. Yarn packages 24 are held beforehand on the second bar 15 by the yarn package holding devices 16. The frame 3 is moved in the direction of an arrow H by the motor 10 to locate the yarn packages 24 opposite to the pegs 22, respectively. The carriage 1 is moved together with the frame 3 in the direction of the arrow F to put the yarn packages 24 on the pegs 22, the grippers 19 are retracted by the pneumatic actuators 17 to release the yarn packages from the yarn package holding devices 16, the carriage 1 is moved together with the frame 3 by the motor 6 in the direction of the arrow E to separate the yarn package holding devices 16 from the yarn packages 24. Subsequently, the yarn package transfer frame 4 is turned by a motor 25 on a second shaft 26 through an angle of 90° in the direction of an arrow A, and then the yarn package transfer frame 4 is turned by a motor 27 on a first shaft 28 in the direction of an arrow D. Then, the carriage is moved together with the frame 3 by the motor 6 in the direction of the arrow E to locate the first bar 13 of the yarn package transfer frame 4 above an empty bobbin conveyor 30 and to locate the second bar 15 above a yarn package conveyor 31. Then, the grippers 19 of the empty bobbin holding devices 14 are retracted by the pneumatic actuators 17 to drop the empty bobbins 33 onto the empty bobbin conveyor 30 for transportation. Then, a lifter 35 is lowered by a cylinder actuator 34 to insert the hollow shafts 20 of the yarn package holding devices 16 in the bores of yarn packages 24 arranged on the yarn package conveyor 31, and then the grippers 19 are projected from the hollow shafts 20 by the pneumatic actuators 17 to hold the yarn packages 24. Subsequently, the lifter 35 is raised to its working position by the cylinder actuator 34, the yarn package transfer frame 4 is turned by the motor 27 on the first shaft 28 in the direction of an arrow C while the carriage 1 is moved together with the frame 3 by the motor 6 in the direction of the arrow F, and then the yarn package transfer frame 4 is turned by the motor 25 on the second shaft 26 to set the yarn package transfer frame 4 in a position shown in FIG. 1. Meantime, the creel 21 is shifted to locate the next row of pegs 22 supporting empty bobbins opposite to the yarn package transfer frame 4.

A series of such steps of empty bobbin removing and yarn package supplying operation is repeated to remove empty bobbins from the creel 21 and to supply yarn packages to the creel 21.

If the pegs are arranged zigzag, the empty bobbin holding devices on the first bar 14 or the yarn package holding devices on the second bar 15 can exactly be located opposite to the pegs 22 by vertically shifting the yarn package transfer frame 4.

Another operation of the apparatus of the present invention is illustrated in FIGS. *7a* to *7d*. In this case, the carriage 1 is moved in only advancing or retracting direction to the pegs of the creel (in the direction of the arrows E and F in FIG. 3), while the creel 21 is moved by every one pitch. The chucks 14 and 16 provided on the carriage 1 are arranged in the same pitch as the pegs 22 are arranged on the creel 21 so that the empty bobbin removing and yarn package supplying operation is performed simultaneously. FIG. *7a* shows the state in which the carriage 1 is advanced in the direction of an arrow F and the yarn package P1 supplying operation and the empty bobbin B1 extracting operation are done simultaneously. Subsequently, in the step of FIG. *7b*, the carriage 1 discharges the extracted empty bobbin onto the conveyor 30 shown in FIG. 1 and a yarn supply package on the conveyor 31 is chucked. Then, the creel 21 is moved by one pitch in the direction of the arrow K as shown in FIG. *7c* and the empty bobbin B2 extracting operation and the yarn package P2 supplying operation are performed again in the state as shown in FIG. *7d*. Thus, the empty bobbin removing and yarn package supplying operation for one row of creel can be done simultaneously during one stroke movement of the carriage.

Figure 4:
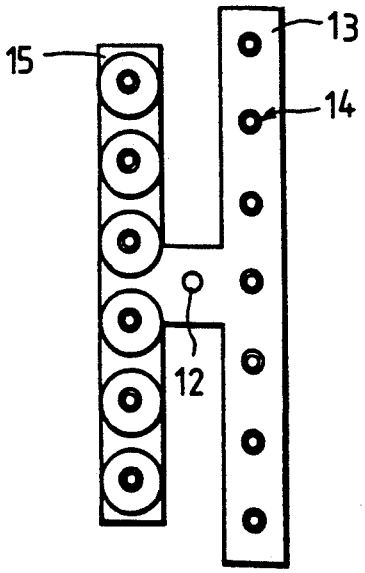

When the pegs are arranged zigzag, the empty bobbin holding devices and the yarn package holding devices may be disposed as shown in FIG. 4. The empty bobbin holding devices and the yarn package holding devices may be substituted by any suitable devices.

As is apparent from the foregoing description, the yearn package supply and empty bobbin removing apparatus in accordance with the present invention is capable of efficiently achieving operations for removing empty bobbins from the creel and supplying yarn packages to the creel in half the time required by the known apparatus for the same operations.

What is claimed is:

1. In a warper creel having a plurality of pegs arranged in a plurality of rows, each adjacent pair of rows defining a distance therebetween, an apparatus for removing empty bobbins from the plurality of pegs and for putting yarn packages onto the plurality of pegs, the apparatus comprising:

a yarn package transfer frame comprising a first bar and a second bar, the first bar and the second bar being substantially mutually parallel, a first plurality of holding devices associated with the first bar, a second plurality of holding devices associated with the second bar, the first and second plurality of holding devices being mutually spaced by a distance corresponding to the distance between adjacent rows of pegs, whereby the yarn package transfer frame is shiftable by a distance corresponding to the distance between adjacent rows of pegs and whereby at least one of the first and second plurality of holding devices is positionable opposite from pegs from which empty bobbins have been removed.

2. The apparatus as claimed in claim 1, comprising:

a support frame for supporting the yarn package transfer frame, at least one first rail along which the support frame is movable, a carriage for supporting the at least one first rail, and at least one second rail along which the carriage is moveable, the at least one first rail and the at least one second rail being substantially mutually perpendicular.

3. The apparatus as claimed in claim 2, comprising:

a first shaft for rotatably supporting the yarn package transfer frame, and a second shaft for rotatably supporting the yarn package transfer frame, the first shaft and the second shaft being substantially mutually perpendicular.

4. The apparatus as claimed in claim 2, wherein at least one of the bobbins defines an inner surface and wherein at least one of the holding devices comprises:

gripper means for engaging the inner surface of the bobbins and for holding the bobbin, a hollow shaft into which the gripper means is retractable, and pneumatic actuator means for projecting the gripper means from the hollow shaft to engage the inner surface of the bobbin.

5. The apparatus as claimed in claim 1, wherein the pegs associated with the creel define a first mutual spacing, wherein the holding devices associated with the yarn package transfer frame define a second mutual spacing, and wherein the first mutual spacing corresponds to the second mutual spacing.

* * * * *